US005630231A

United States Patent [19]

Stevens

[11] Patent Number: 5,630,231

[45] Date of Patent: May 20, 1997

[54] GATHERING CLIP FOR GOWN TRAIN

[76] Inventor: Alexandria A. Stevens, 24 Abbott St., Gardner, Mass. 01440

[21] Appl. No.: 588,913

[22] Filed: Jan. 19, 1996

[51] Int. Cl.[6] ..... A41F 19/00

[52] U.S. Cl. ..... 2/217; 2/336; 2/243.1; 24/358

[58] Field of Search ..... 2/217, 210, 223, 2/300, 301, 271, 243.1, 336; 24/358, 359, 108, 103, 710.5

[56] References Cited

U.S. PATENT DOCUMENTS

| | | | |
|---|---|---|---|
| 56,341 | 7/1866 | Phelps . | |
| 57,950 | 9/1866 | Moody . | |
| D. 248,900 | 8/1978 | Weitzbuch . | |
| 473,232 | 4/1892 | Long | 24/359 |
| 497,516 | 5/1893 | Brewer . | |
| 593,569 | 11/1897 | Dean . | |
| 705,159 | 7/1902 | Sutherland | 24/359 |
| 724,518 | 4/1903 | Sutton . | |
| 726,830 | 4/1903 | Wheelock . | |
| 891,739 | 6/1908 | Schwotzer . | |
| 905,705 | 12/1908 | Johnson . | |
| 1,745,553 | 2/1930 | Mitmann | 24/358 |
| 1,900,979 | 3/1933 | DeMent | 24/358 X |
| 3,064,268 | 11/1962 | Nania | 2/217 |
| 3,165,755 | 1/1965 | Graham | 2/217 |
| 5,052,059 | 10/1991 | Speer . | |

FOREIGN PATENT DOCUMENTS

| | | | |
|---|---|---|---|
| 1174 | of 1904 | United Kingdom | 2/217 |
| 19317 | of 1904 | United Kingdom | 2/217 |

*Primary Examiner*—Amy B. Vanatta
*Assistant Examiner*—Shirra L. Jenkins
*Attorney, Agent, or Firm*—Richard C. Litman

[57] ABSTRACT

A gathering clip for bridal and other gown trains, capes, and other trailing components of formal wear, is removably securable to the inside structure of the garment along a back central seam allowance therein, thus being completely hidden from view when installed. The clip generally comprises a first and a second link, each of which includes a pin which is used to penetrate the hidden hem or seam allowance which is formed within the back of the gown when the left and right rear panels of the gown and train are constructed. The two links may be removably secured respectively to the back hem of the gown beneath the waistband, and to the underside of the train at some point along the central portion thereof or as desired, and retained by buttons which are snapped over the ends of the pins. The links may be left unconnected to allow the train to extend behind the gown in trail, but may be easily clipped or snapped together by a cooperating pin and receptacle in the two components, to gather the train when desired. When the gown is later removed for cleaning and/or storage, the clip components may be removed for use in another gown. The clip is relatively inexpensive, and may be formed of a pliable plastic material in order to provide for the snapping together of the various components.

17 Claims, 2 Drawing Sheets

GATHERING CLIP FOR GOWN TRAIN

BACKGROUND OF THE INVENTION

1. Field of the Invention

The present invention relates to clips, snaps, buttons, and other similar devices used as apparel fasteners and the like, and more specifically to a two part clip which is particularly adapted to gather and secure the train of a bridal gown or other gown to preclude the dragging or trailing of the train behind the wearer when such is not desired. The two major portions of the present clip are secured through the longitudinal hem or seam allowance extending along the inside of the back of the gown and train, where the clip components are not visible. They may be secured together or separated as desired respectively to gather or release the train.

2. Description of the Prior Art

The wearing of beautiful, flowing gowns with long trailing trains is a tradition at many formal affairs and gatherings. Such gowns are typically worn by brides at weddings, but may also be worn by ladies at many other formal functions, from debutante balls to various other formal high social gatherings. In fact, a garment having a trailing portion may also be worn by men in some formal occasions, as in a cape or similar long trailing garment extension.

While such gowns and garments are most attractive and impressive when the train portion is extended behind the wearer, the train can become somewhat cumbersome during some portions of the affair, e.g., at a wedding, after the ceremony has been completed and the bride is leaving the location where the ceremony was performed. Generally, the bride will continue to wear the gown at a reception following the ceremony, where normal activities requiring the bride to circulate among the guests, and to be seated for the reception dinner, etc., are expected. This is most inconvenient with an extended trailing train, and accordingly various devices have been developed in the past which serve to gather the train in some form or another. However, each of these devices of the prior art requires some permanent installation in the gown, is not reusable or transferable to another garment, is not adjustable, and/or requires some cumbersome manipulation of the garment, as will be seen below in the discussion of the specific prior art publications known to the applicant.

U.S. Pat. No. 56,341 issued to Thomas V. Phelps on Jul. 10, 1866 describes a Skirt Elevator comprising a strap which passes back through a pair of rings secured to one end thereof. The distal end of the strap is secured to a lower or trailing portion of the garment, while the end adjacent the rings is secured to the upper portion. Adjustment may be made by pulling the loop adjacent the upper end, with the adjustment being held by capture between the rings. No disclosure is made of any removable installation of the strap in a garment, as provided by the present invention.

U.S. Pat. No. 57,950 issued to S. A. Moody on Sep. 11, 1866 describes a Skirt Elevator comprising a length of elastic cord having a toggle on the distal end thereof. The opposite end from the toggle is secured to the fabric of the skirt. A series of rings is secured below the cord, whereby the toggle may be looped through any one of the rings to lift the skirt to the degree desired. Moody discloses the installation of a plurality of such devices along a skirt, thereby requiring that the attachment end of the cord and the rings be sewn through the skirt material itself, rather than through the material of a central hem to the inside of the skirt. While the raising of the lower edge of the skirt at several points may be desirable in some instances, the attaching of the components through the skirt material results in an unsightly series of stitches or other attachment means being visible on the outer surface of the skirt, unlike the present invention.

U.S. Pat. No. 497,516 issued to John M. Brewer et al. on May 16, 1893 describes a Skirt Supporter comprising an upper clasp which clamps to a fold in the skirt fabric, and a lower loop in which a small gathered portion of the skirt fabric is pinched to secure the fabric therein. The clasp and loop are removably secured together to lift a portion of the skirt. The Brewer et al. device is adapted for use on the outer surface of the skirt, as evidenced by FIG. 1 of the drawings and also the statement that the lower end of the loop is in "ornamental form" (p. 1, line 49), which form would be pointless in the case of the Brewer et al. skirt supporter being worn beneath the skirt.

U.S. Pat. No. 593,569 issued to Augusta E. Dean on Nov. 16, 1897 describes a Skirt Adjuster comprising a pair of engageable wire elements which are hinged together. The elements are permanently sewn into the skirt, or alternatively sewn to fabric backing piece, which is in turn sewn into the skirt. The two wire elements provide no adjustment, as each element is of fixed length and engages with the other element in a non-adjustable relationship. Each component of the device would have to be made to an excessive length to gather the train of a gown or the like, in which case the relatively stiff wire elements would tend to disrupt the flowing lines of the gown train. In contrast, the present clip components are removable, and may be adjustably and removably positioned in the gown and train as desired according to the length of the train and other factors.

U.S. Pat. No. 724,518 issued to James P. Sutton on Apr. 7, 1903 describes a Skirt Elevator adapted to be worn externally at the hip or side of the skirt, as evidenced by the ornamental features disclosed (i.e., lines 49–51 and the hand-like portrayal of the clamps of FIGS. 1 and 2). As the device is intended to be worn to the side, rather than to the back of the skirt, the central bar includes a pin on the back thereof serving to secure the device to the skirt to preclude excessive fore and aft swinging of the device while the wearer is walking. The main support of the device is accomplished by a pair of hooks which secure to a belt, which securing means is not possible with a clip disposed beneath the skirt material, as in the present invention.

U.S. Pat. No. 726,830 issued to Etta W. Wheelock on Apr. 28, 1903 describes a Skirt Holding Device including various decorative features, and adapted for wear upon the outer surface of the skirt. The upper portion of the device hooks over the belt or waistband of the skirt or dress, while the lower portion clamps to a fold formed in the skirt. The device cannot be worn beneath the skirt due to the lack of a belt or waistband therein for the attachment of the upper clasp or hook, whereas the present clip is adapted for attachment beneath the outer surface of the skirt or gown train, and is completely hidden by the gown and/or train whether the train is gathered or extended.

U.S. Pat. No. 891,739 issued to Walter W. Schwotzer on Jun. 23, 1908 describes a Skirt Supporter which functions similarly to the Sutton and Wheelock devices discussed above. A hook is secured externally over a waistband, and a spring clip is used to grasp a folded portion of the outer skirt. While the device is detachable and may be transferred from one garment to another, it comprises essentially a single apparatus having a cord extending between the upper belt hook and the lower clasp; the upper and lower components are not detachable from one another. Thus, the two end components cannot be preassembled to the gown and secured together as required at a later stage, as provided with the present clip, but must be completely removed when it is desired to let the skirt or train out to a completely extended state, as is apparent by FIG. 1 of the Schwotzer disclosure wherein the adjustment clip is positioned to provide maximum extension of the cord while still lifting the skirt.

U.S. Pat. No. 905,705 issued to Nels Johnson on Dec. 1, 1908 describes a Supporter comprising a pair of oppositely extending clasps which are secured together at a single central point. Each of the clasps includes a wire or similar keeper, which is slid along the clasp to secure the ends thereof about a fold in the garment. The two clasp portions are permanently secured together, unlike the separable configuration of the two components of the present clip. As in several of the prior art disclosures discussed above, the Johnson device is adapted to secure to the outer belt of the skirt (lines 67–68), unlike the present clip, which is adapted to be secured in a hidden position beneath the skirt or train.

U.S. Pat. No. 5,052,059 issued to Nancy D. Speer on Oct. 1, 1991 describes a Wedding Gown Train Hoop With Integral Wrist Strap, comprising an openable loop of relatively stiff material having an external band of relatively greater length therearound. The ends of the loop of stiff material may be connected together with the longer end of the external band secured thereby, to form a generally circular stiff loop of material through which a portion of the gown train may be passed for support and carriage thereof, with the secondary band being used as a wrist strap or support. By its nature, the Speer hoop and strap arrangement are only adapted for wear to the outside of the skirt or train, by means of the wrist strap formed therewith. The device does not attach or secure to the gown or train, as with the present clip, and the two loops are not separable from one another, whether open or closed.

U.S. Pat. No. D-248,900 issued to Diane Weitzbuch on Aug. 15, 1978 describes a design for a Train Ring somewhat along the lines of the Speer device discussed above. The Weitzbuch ring design does not disclose a secondary wrist loop, however, nor is any means apparent for securing the device to either the outer or the inner surface of a gown or train. No separable components which are removably attachable to a garment to gather a portion thereof selectively, is evident in the Weitzbuch design disclosure, Finally, applicant is aware of a system of ribbons which are installed in bridal gowns manufactured by the VanLear Company, for the purpose of gathering the gown train. However, the ribbons are permanently sewn in place, and cannot be removed for relocation within a gown for the adjustment of the gathered length of the gown train, or transferred to other gowns, which features are provided by the present gathering clip. Moreover, the VanLear ribbons are relatively cumbersome to manipulate, as they require tying together to secure the gown train in a gathered position. The present clip includes two links which need only be snapped together once installed within the gown and train.

None of the above inventions and patents, taken either singly or in combination, is seen to describe the instant invention as claimed.

SUMMARY OF THE INVENTION

Accordingly, it is a principal object of the invention to provide a gathering clip for gown trains and the like, which provides for the selective gathering or extending of the train.

It is another object of the invention to provide an improved gathering clip which is removably securable to a gown and train or the like, and which is completely concealed beneath the gown skirt and train when installed therein, with the gown and train being completely devoid of any clip components or attachment means therefor, extending through the gown or train material.

It is a further object of the invention to provide an improved gathering clip which generally comprises two selectively securable components, one of which is removably secured generally beneath the waist of the gown, and the other of which is removably secured generally beneath a midpoint area of the train.

Still another object of the invention is to provide an improved gathering clip which components each include a pin which is removably securable to the seam allowance extending to the inside of the gown and train from a central back seam formed therein.

It is a final object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
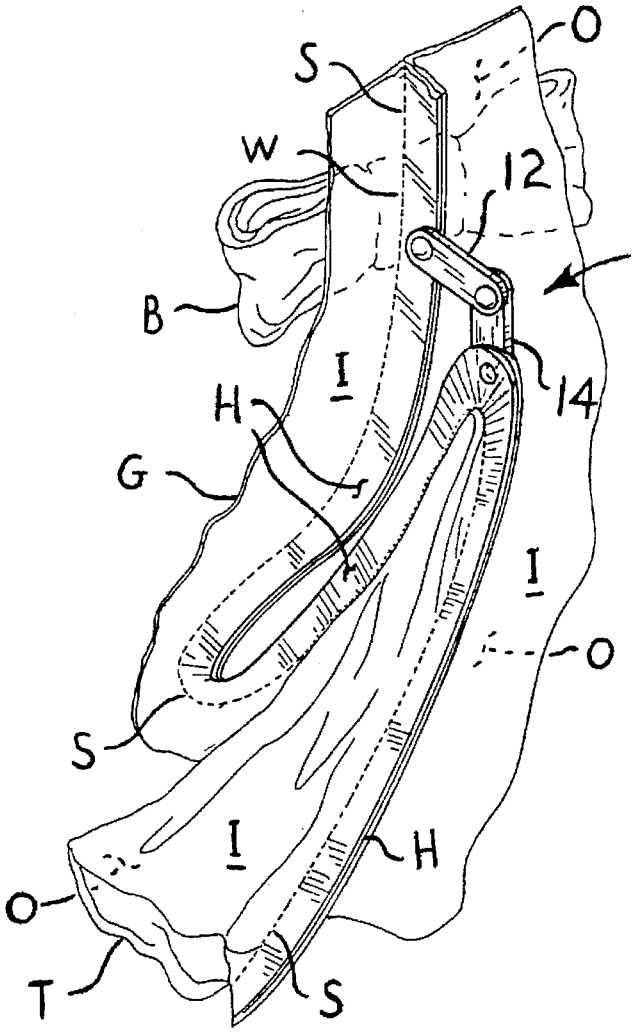
FIG. 1 is a detail perspective view in section of the inner portion of a gown and showing the back seam allowance therein, and showing the present gathering clip components secured thereto and attached to one another to gather the train.
Figure 2:
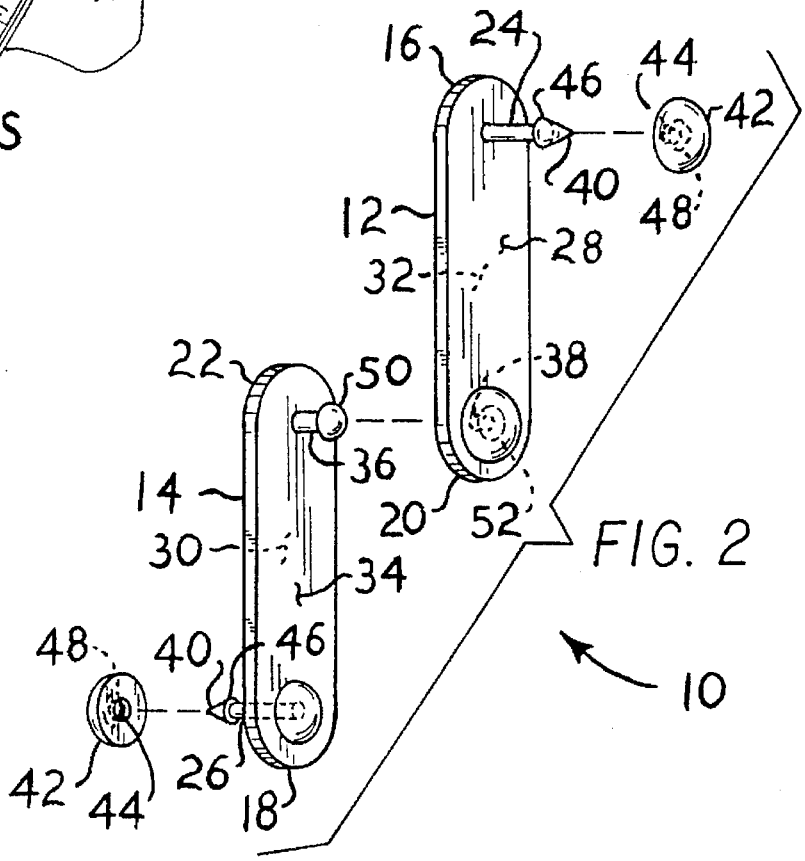
FIG. 2 is an exploded perspective view of the components of the present gathering clip.

Referring now particularly to FIGS. 1 and 2 of the drawings, the present invention will be seen to comprise a gathering clip 10 which is particularly adapted to secure to an inwardly facing hem H of a gown or other garment G. The clip 10 serves to secure a train T or other extension (cape, etc.) of the gown or garment G selectively in a gathered or extended configuration, as desired, in order to provide greater convenience for the wearer of the garment when greater mobility is required.

FIG. 2 provides a detailed view of the various components of the present gathering clip 10. The clip 10 generally comprises a first link 12 and a second link 14 which is selectively attachable or removable from the first link 12. Each link 12 and 14 is preferably formed as a flat, thin, elongated piece or sheet of material, in order to reduce bulk when applied to a garment G. Other configurations (cylindrical, etc.) may be formed alternatively, if desired.

Each of the links 12 and 14 has a first end, respectively 16 and 18, and an opposite second end, respectively 20 and 22, for the two links 12 and 14. These ends 16 through 22 are preferably smoothly rounded, in order to reduce the potential hazard of snagging on the expensive gown or garment to which they may be secured. Each of the first ends 16 and 18 has a garment or gown attachment pin, respectively 24 and 26, extending perpendicularly from the first surface, respectively 28 and 30, of the two links 12 and 14.

Each link 12 and 14 also has an opposite second surface, respectively 32 and 34, due to the flat nature of the link configuration. These second surfaces 32 and 34 face one another when the two links are connected together, with the second link 14 having a link connecting pin 36 extending perpendicularly from the second surface 34 thereof, adjacent the first end 22, and the first link 12 having a cooperating receptacle 38 formed in the second surface 32 and adjacent the second end 20 thereof, adapted to engage the connecting pin 36 to secure the two links together.

The two garment/gown pins 24 and 26 are each provided with a sharp point 40, adapted for the penetration of at least two layers of fabric as normally found in the hem H of a garment G. In order to secure the two attachment pins 24 and 26 positively within the fabric hem material, and to preclude damage to other areas of the garment or gown G, a pair of smoothly rounded retaining buttons 42 are provided, one for each of the pins 24 and 26. Each of the buttons 42 includes a garment or gown attachment pin receptacle 44 therein, adapted to fit closely over the pins 24/26 and to preclude the pins from being inadvertently withdrawn from the hem H.

Additional security is provided by means of a widened flange 46 formed on the distal end of each of the garment or gown attachment pins 24 and 26, which are positively captured by an internal relief 48 within each of the button receptacles 44. By forming the various clip components (links, pins, and buttons) of a resilient, pliable material (e.g., plastic, etc.), the widened flanges 46 on the ends of the pins 24/26 will snap into the reliefs 48 within the buttons 42, to secure the buttons 42 positively on the ends of the pins 24/26 until intentionally removed.

In a like manner, the link connecting pin 36 of the second link 14 may include a widened flange 50 on its distal end (preferably rounded, to preclude snagging the fabric when removed from the first link 12), which positively engages a widened relief 52 formed within the link pin receptacle 38 of the first link 12. Thus, the two links may be snapped together, in the same manner as described above for the garment/gown attachment pins and buttons.

The two links 12 and 14 are secured to the longitudinal rear central hem H, which is typically formed in a garment or gown G when the two rear fabric panels for the gown or garment G are sewn together along a seam S during construction of the garment. This link attachment procedure is as described above in the detailed discussion of the components of FIG. 2, and as shown in FIG. 1. Preferably, the first link 12 is secured to the internal hem H to the inside or inner surface I of the gown or garment material, and generally adjacent the waist area W of the gown or garment G. (The decorative bow B displayed at the back of the gown G of FIG. 3, is also shown in FIG. 1 secured to the outer surface 0 of the gown G, to assist in the orientation of the view of FIG. 1.)

The second link 14 is also secured along the hem H to the inside of the garment or gown G, but farther down along the train T or other extension, generally approximately midway between the train or extension attachment point at the waist W of the gown or garment G and the distal end of the train T or extension. This is preferably done at the time the garment or gown G is readied for wear, but may be accomplished after the gown G is in place on the person wearing the garment. In any case, it will be seen that by using the hem H which is conventionally found longitudinally along the central back portion of the gown or garment G, the attachment pins 24/26 of the two links 12/14 do not penetrate the inner or outer surfaces I/O of the fabric material forming the gown or garment G, and thus none of the components of the gathering clip 10 are visible from the outside of the gown or garment G.

Figure 3:
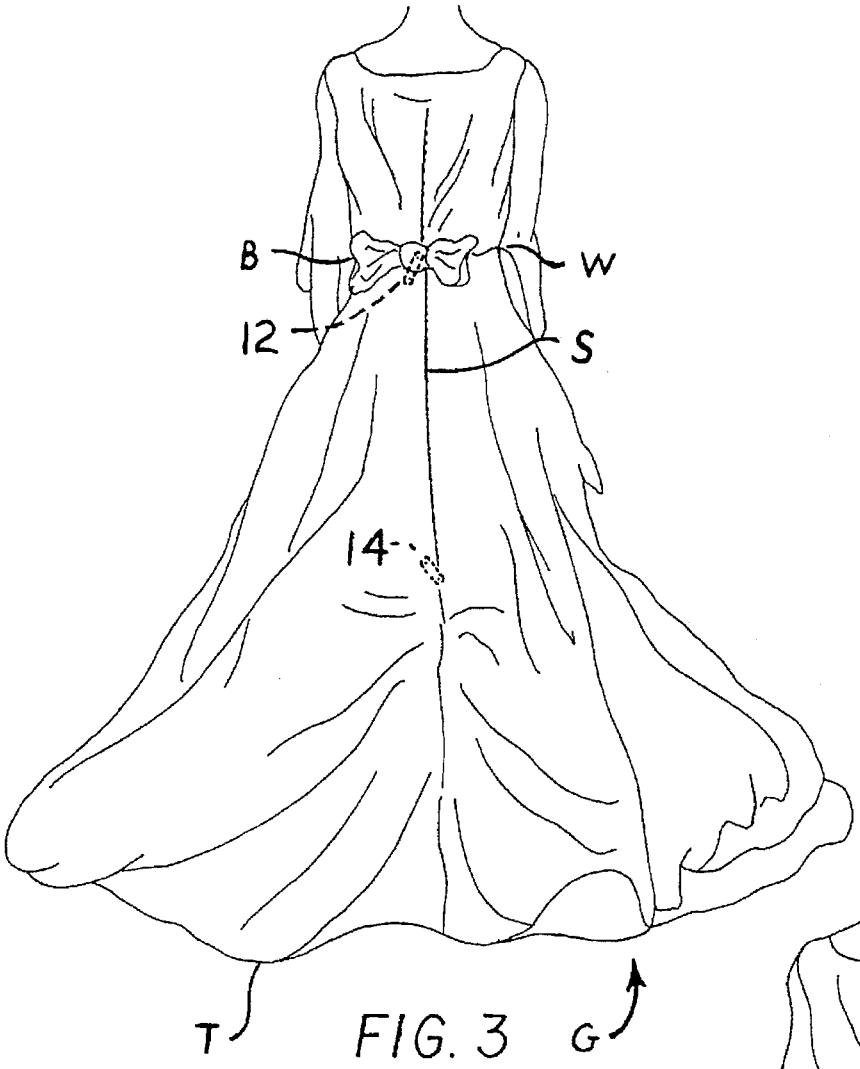
FIG. 3 is a rear perspective view of a gown with the train extending rearwardly therefrom, with the separated link components of the present gathering clip shown in broken lines therein.
Figure 4:
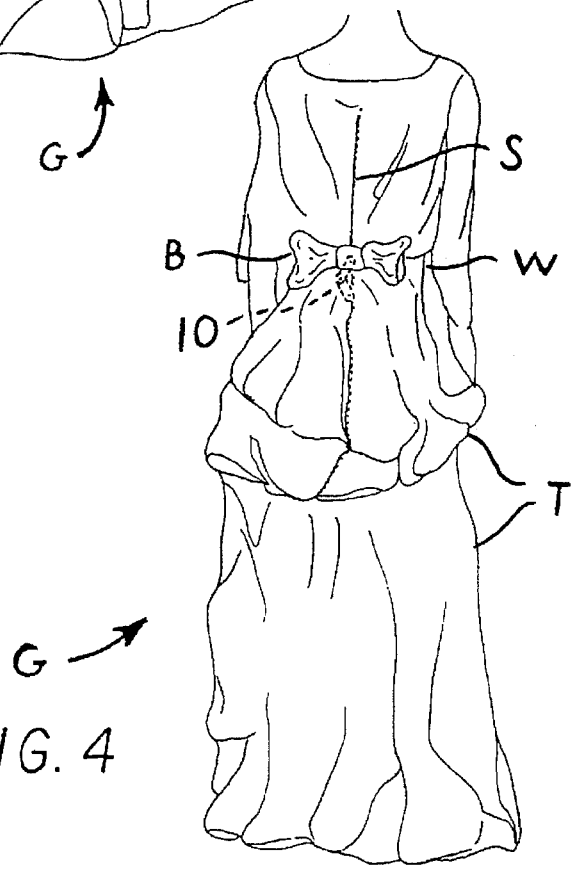
FIG. 4 is a rear perspective view of a gown with the train gathered upwardly therebehind, with the two connected link components of the present clip shown in broken lines therein.

During the more formal portions of the ceremony or other occasion, the two link components 12/14 of the clip 10 may be left disconnected, to allow the train T or other garment extension to trail and flow freely behind the wearer, as shown in FIG. 3 of the drawings. However, when greater mobility is desired for the wearer, as at a reception following a wedding ceremony, the two links 12 and 14 may be easily connected by an assistant (bridesmaid, etc.) reaching up under the train T to grasp the second link 14, and snapping it in place to connect it to the first link 12, as described in detail further above. This gathers the train T up into a "bustled" configuration, as shown in FIG. 4, to allow the wearer to move about and circulate more easily, and greatly reduces the potential hazard of the train T being inadvertently caught or snagged on some object or another, accidentally stepped on by another person, and/or becoming excessively soiled.

When the gown or garment G is removed after use, the clip 10 may be easily removed from its anchor points through the hem H by unsnapping the two retaining buttons 42/44 from their respective garment attachment pins 24/26, withdrawing the pins 24/26 from the hem H, and replacing the buttons 42/44 on the pins 24/26 to retain the clip components together for future use. (Preferably, the pins 24/26, and the link connecting pin 36, are monolithically molded or otherwise formed as a single unit with their respective links 12/14, in order to provide for the efficient manufacture of the present clip 10, particularly when formed of plastic or the like.)

In summary, the present gathering clip 10 will be seen to provide a most convenient means of selectively gathering or releasing the train or other trailing extension of a gown or other garment, as desired and dictated by the circumstances and environment where the garment is being worn. The present gathering clip 10 is primarily adapted for use in gathering the long, flowing train of a bridal gown or other formal gown, as in the gowns G of FIGS. 3 and 4. However, it will be seen that many other types of garments, not limited to ladies' gowns, also may include a long, trailing extension of some sort, such as a man's cape or the like. The present clip 10 may be adapted for use in gathering such cape extensions or the like, as well as for its primary use with wedding and other formal gowns G. The structure of the present clip 10, providing for its complete removal from a garment G to which it may be temporarily and removably secured, allows the clip 10 to be attached to virtually any type of garment G to which the user may wish to apply it. The versatility, ease of use, completely concealed nature, and economy of the present clip 10 will be seen to provide widespread utility in achieving the intended purposes.

It is to be understood that the present invention is not limited to the sole embodiment described above, but encompasses any and all embodiments within the scope of the following claims.

I claim:

1. A gathering clip for a trailing extension of a garment, comprising:

a first link and a second link, with each said link having a garment attachment pin extending therefrom adapted to removably penetrate and secure to the fabric of the garment and extension;

said second link further including a link connecting pin, and said first link including a link connecting pin receptacle, with said second link and said first link being removably securable to one another by said connecting pin and said pin receptacle;

a smoothly rounded retaining button adapted to secure removably over each said garment attachment pin of each said link, with each said button including a receptacle formed therein adapted to fit closely over each respective said garment attachment pin, whereby;

said first link is removably secured to a portion of the garment and said second link is removably secured to a portion of the trailing extension, with said first link and said second link being selectively connected together or disconnected respectively to gather the extension to the garment or to permit the extension to extend freely behind the garment as desired.

2. The gathering clip of claim 1, wherein:

said clip and each said retaining button are formed of a resilient, pliable plastic material;

each said garment attachment pin and said link connecting pin each include a distal end having a widened flange thereon, and;

each said retaining button and said pin receptacle of said first link each include a cooperating internal relief adapted to fit resiliently over and capture one said widened flange respectively of each said garment attachment pin and said link connecting pin.

3. The gathering clip of claim 1, wherein:

each said link comprises an elongate flat, thin sheet of material having a smoothly rounded first end and an opposite smoothly rounded second end, with each said garment attachment pin extending perpendicularly respectively from each said first end of each said link, said link connecting pin of said second link extending from said second end thereof, and said link pin receptacle of said first pin disposed within said second end thereof.

4. The gathering clip of claim 3, wherein:

each said link includes a first surface and an opposite second surface, with said garment attachment pin of said second link extending from said first surface thereof and said link connecting pin of said second link extending from said second surface thereof.

5. The gathering clip of claim 1, wherein:

said first link and said garment attachment pin extending therefrom, and said second link and said garment attachment pin and said link connecting pin extending therefrom, are each respectively monolithically formed as a single unitary component.

6. In a gown having a train extending rearwardly therefrom, with the gown and train having a rearwardly and inwardly disposed hem extending along the gown and train, a gathering clip comprising:

a first link and a second link, with each said link having a gown attachment pin extending therefrom adapted to removably penetrate and secure through the hem respectively of the gown and train;

said second link further including a link connecting pin, and said first link including a link connecting pin receptacle, with said second link and said first link being removably securable to one another by said connecting pin and said pin receptacle, each said link being an elongate flat, thin sheet of material having a smoothly rounded first end and an opposite smoothly rounded second end, each said gown attachment pin extending perpendicularly respectively from each said first end of each said link, said link connecting pin of said second link extending from said second end thereof, and said link pin receptacle of said first pin disposed within said second end thereof, whereby;

said first link is removably secured to the hem of the gown and said second link is removably secured to the hem of the train, with said first link and said second link being selectively connected together or disconnected respectively to gather the train to the gown or to permit the train to extend freely behind the gown as desired.

7. The gathering clip of claim 6, including:

a smoothly rounded retaining button adapted to secure removably over each said gown attachment pin of each said link, with each said button including a receptacle formed therein adapted to fit closely over each respective said gown attachment pin.

8. The gathering clip of claim 7, wherein:

said clip and each said retaining button are formed of a resilient, pliable plastic material;

each said gown attachment pin and said link connecting pin each include a distal end having a widened flange thereon, and;

each said retaining button and said pin receptacle of said first link each include a cooperating internal relief adapted to fit resiliently over and capture one said widened flange respectively of each said gown attachment pin and said link connecting pin.

9. The gathering clip of claim 6, wherein:

each said link includes a first surface and an opposite second surface, with said gown attachment pin of said second link extending from said first surface thereof and said link connecting pin of said second link extending from said second surface thereof.

10. The gathering clip of claim 6, wherein:

said first link and said gown attachment pin extending therefrom, and said second link and said gown attachment pin and said link connecting pin extending therefrom, are each respectively monolithically formed as a single unitary component.

11. In combination with a gown having a waist portion with a train attached thereto and extending rearwardly therefrom, with said gown and said train each having an outer surface with a longitudinal rear central seam and an inwardly disposed hem extending from said seam along said gown and said train, a gathering clip comprising:

a first link and a second link, with each said link having a gown attachment pin extending therefrom adapted to removably penetrate and secure through said hem respectively of said gown and said train so that said outer surface of said gown and said train are devoid of direct contact with said clip;

said second link further including a link connecting pin, and said first link including a link connecting pin receptacle, with said second link and said first link being removably securable to one another by said connecting pin and pin receptacle;

a smoothly rounded retaining button adapted to secure removably over each said gown attachment pin of each said link, with each said button including a receptacle formed therein adapted to fit closely over each respective said gown attachment pin, whereby;

said first link is removably secured to said hem near said waist portion of said gown and said second link is removably secured to said hem of said train, with said first link and said second link being selectively connected together or disconnected respectively to gather said train to said gown or to permit said train to extend freely behind said gown as desired.

12. The gown and gathering clip combination of claim 11, wherein:

said clip and each said retaining button are formed of a resilient, pliable plastic material;

each said gown attachment pin and said link connecting pin each include a distal end having a widened flange thereon, and;

each said retaining button and said pin receptacle of said first link each include a cooperating internal relief adapted to fit resiliently over and capture one said widened flange respectively of each said gown attachment pin and said link connecting pin.

13. The gown and gathering clip combination of claim 11, wherein:

each said link comprises an elongate flat, thin sheet of material having a smoothly rounded first end and an opposite smoothly rounded second end, with each said gown attachment pin extending perpendicularly respectively from each said first end of each said link, said link connecting pin of said second link extending from said second end thereof, and said link pin receptacle of said first pin disposed within said second end thereof.

14. The gown and gathering clip combination of claim 13, wherein:

each said link includes a first surface and an opposite second surface, with said gown attachment pin of said second link extending from said first surface thereof and said link connecting pin of said second link extending from said second surface thereof.

15. The gown and gathering clip combination of claim 11, wherein:

said first link and said gown attachment pin extending therefrom, and said second link and said gown attachment pin and said link connecting pin extending therefrom, are each respectively monolithically formed as a single unitary component.

16. The gown and gathering clip combination of claim 11, wherein:

said gown is a formal gown.

17. The gown and gathering clip combination of claim 11, wherein:

said gown is a wedding gown.

* * * * *